United States Patent [19]

Loney

[11] 4,422,186

[45] Dec. 27, 1983

[54] HOSPITAL GARMENT

[76] Inventor: Ann M. Loney, 2525 W. Washington, Las Vegas, Nev. 89106

[21] Appl. No.: 419,641

[22] Filed: Sep. 17, 1982

Related U.S. Application Data

[63] Continuation of Ser. No. 215,675, Dec. 12, 1980, abandoned.

[51] Int. Cl.[3] ..... A41B 9/00

[52] U.S. Cl. ..... 2/114; 2/DIG. 6

[58] Field of Search ..... 2/114, 74, DIG. 7, DIG. 6

[56] References Cited

U.S. PATENT DOCUMENTS

| | | | |
|---|---|---|---|
| 3,233,248 | 2/1966 | Bushnell | 2/2 |
| 3,276,036 | 10/1966 | Carter | 2/114 |
| 3,805,295 | 4/1974 | Garcia | 2/127 |

*Primary Examiner*—Doris L. Troutman

*Attorney, Agent, or Firm*—David A. Boone

[57] ABSTRACT

A hospital garment comprises finished slits with fasteners which extend the entire length from the collar down the entire length of the sleeve to the wrist portion of the gown. This structure allows the placement and removal of intravenous apparatus as well as surgery or applying or changing bandages without the necessity of removing the gown or cutting it apart. A similar garment is provided for the lower portion of a patient's body.

2 Claims, 8 Drawing Figures

HOSPITAL GARMENT

This is a continuation of application Ser. No. 215,675, filed Dec. 12, 1980 now abandoned.

BACKGROUND AND SUMMARY OF THE INVENTION

Previous hospital gowns have not provided convenient access to the arm and side portions of a patient. For this reason gowns have typically been cut apart or destroyed to allow the placement of intravenous apparatus and for the convenient access to arm and side portions of the patient. This has resulted in the gowns being destroyed for the use by a single patient. These gowns are typically discarded after use by the patient.

In accordance with the preferred embodiment of the present invention, finished slits are provided along the entire length of the shoulder and sleeve portion of a hospital gown. These slits extend the entire length from the shoulder to the wrist portion of the gown. Fasteners are provided along the length of the gown to allow access to the side portion of the patient's body and to allow the closing of the opening after the requirement for access to that portion of the patient's body no longer exists. A similar garment is provided for the lower portion of a patient's body.

DESCRIPTION OF THE PREFERRED EMBODIMENT

Figure 1:
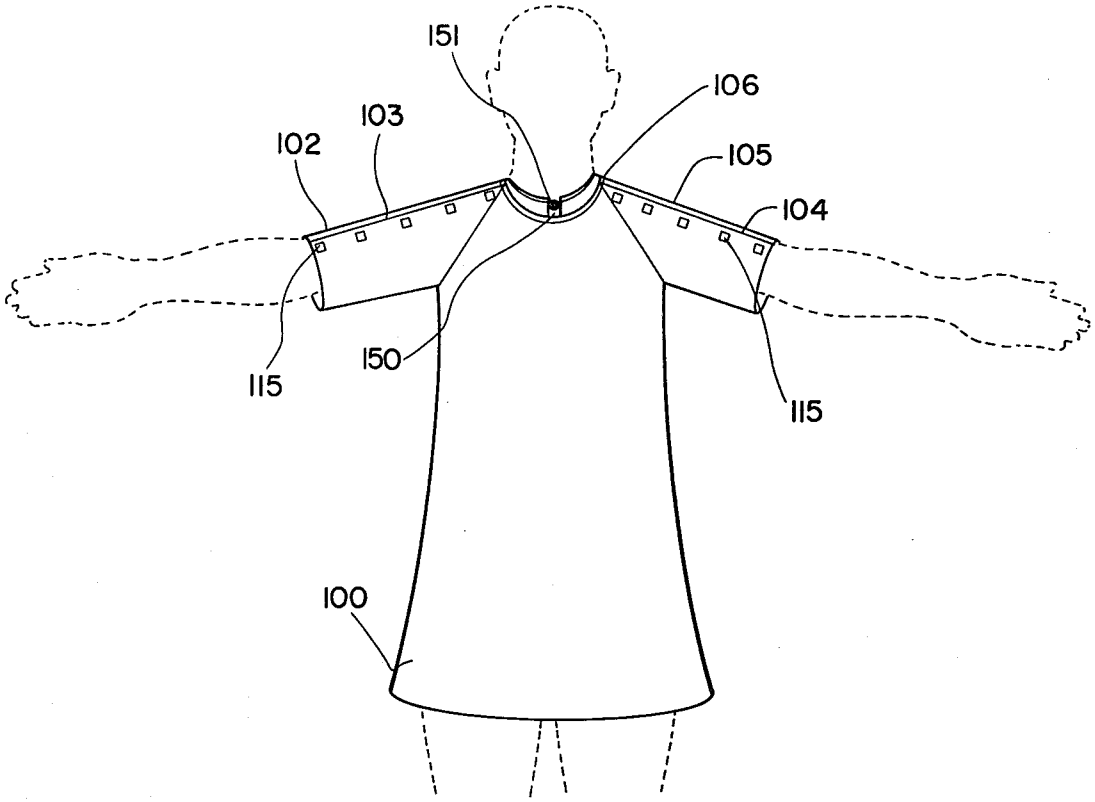
FIG. 1 is a front perspective view of the hospital gown in accordance with the preferred embodiment.

Referring now to FIG. 1, there is shown a front perspective view of the hospital garment in accordance with the preferred embodiment. This gown or garment 100 comprises two finished slits 102 and 104 which extend the entire length of shoulder and sleeve portions 103 and 105 respectively. A preselected number of fasteners 115 are provided along the slit openings to allow the opening and closure of the slit opening. These fasteners may be buttons, ties, snappers or pieces of opposing mating fabric materials, such as those marketed under the trade name "Velcro".

Figure 2:
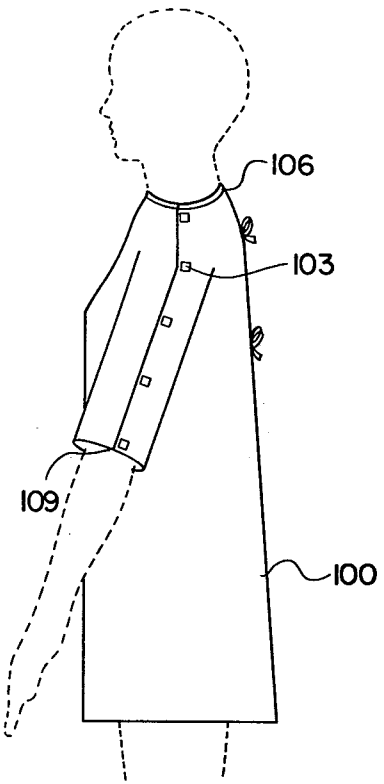
FIG. 2 is a side perspective view of the hospital gown in accordance with the preferred embodiment.

FIG. 2 is a side view of the garment of the preferred embodiment. Note that slit 103 extends the entire length of the arm portion from collar 106 to the end of the arm portion 109. In this way the garment may be totally opened exposing the entire area of the patient's body from the neck to the wrist. If desired, different styles may be provided for men and women. Men's gowns would have wrist length sleeves while women's gowns would be elbow length.

Figure 4:
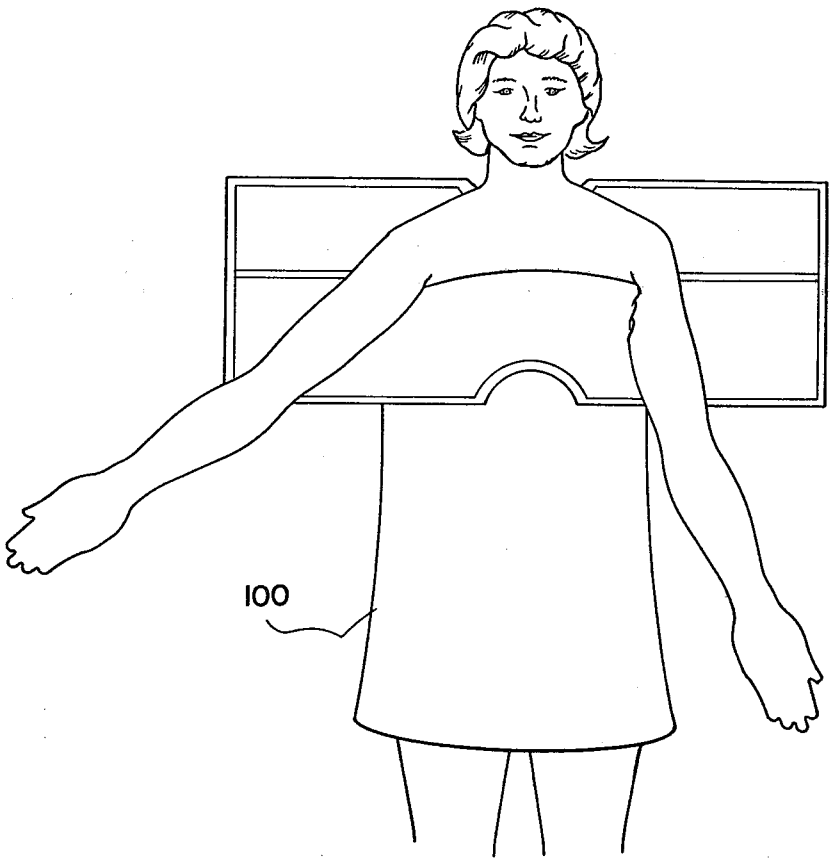
FIG. 4 is a front perspective view showing both arm slits totally open showing how the total access to the shoulder and arm portions of the patient is provided.
Figure 3:
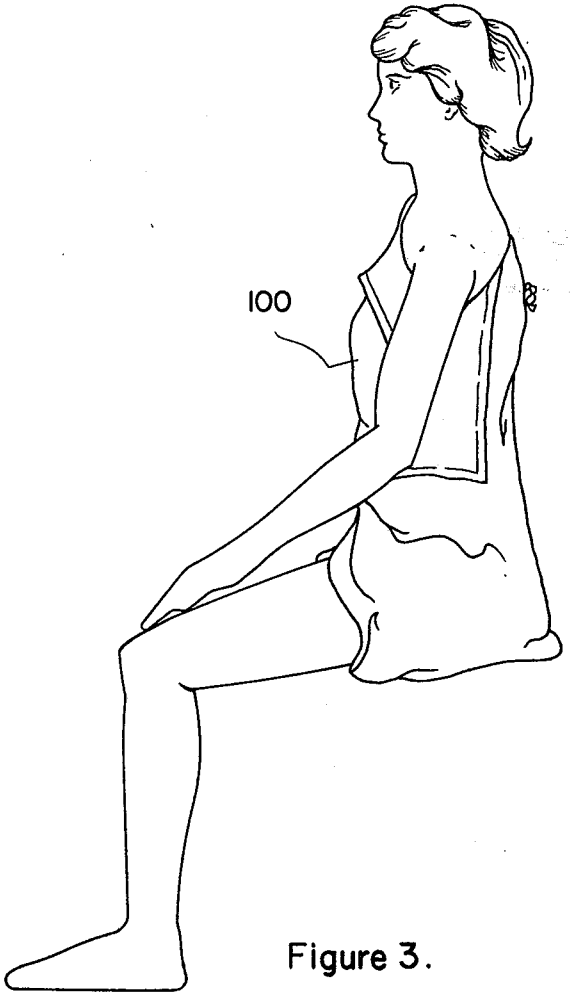
FIG. 3 is a side perspective view of the hospital gown of the preferred embodiment showing it in the open side position on a patient.

Referring now to FIG. 3 there is shown a side view of the garment of the present invention on a patient with the garment open and exposing the entire area of the patient's body from the neck to the wrist portion. FIG. 4 is a front view showing both slits of the garment of the preferred embodiment open and folded back to show how the entire upper chest, shoulder and arm area is easily accessible when both slit openings are in the open position.

Note that fasteners of any of the type described above could also be along an open slit running the full length of the back or front of the garment. This results in an especially trouble-free garment since nothing needs to be pulled over the head and the arms do not need to be inserted in the sleeves. The gown in accordance with the preferred embodiment is thus easily put on and taken off the patient.

Figure 5:
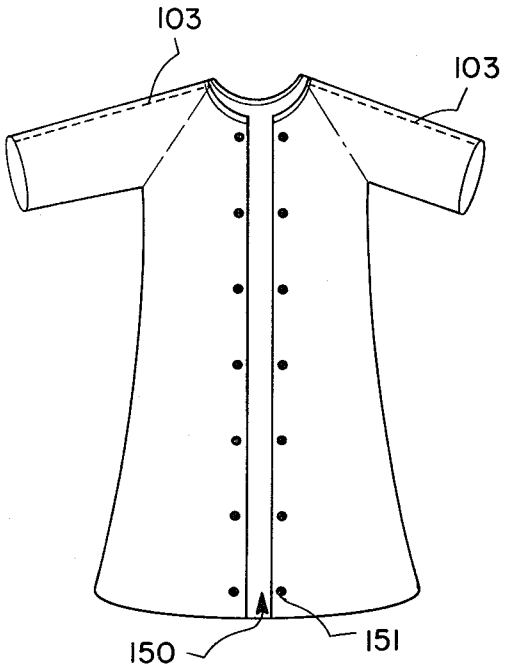
FIG. 5 is a back view of the hospital gown of the preferred embodiment.

An embodiment of the hospital gown having the finished slit in the back of the gown is partially shown in FIG. 1 and fully shown in the rear view of FIG. 5.

Figure 6:
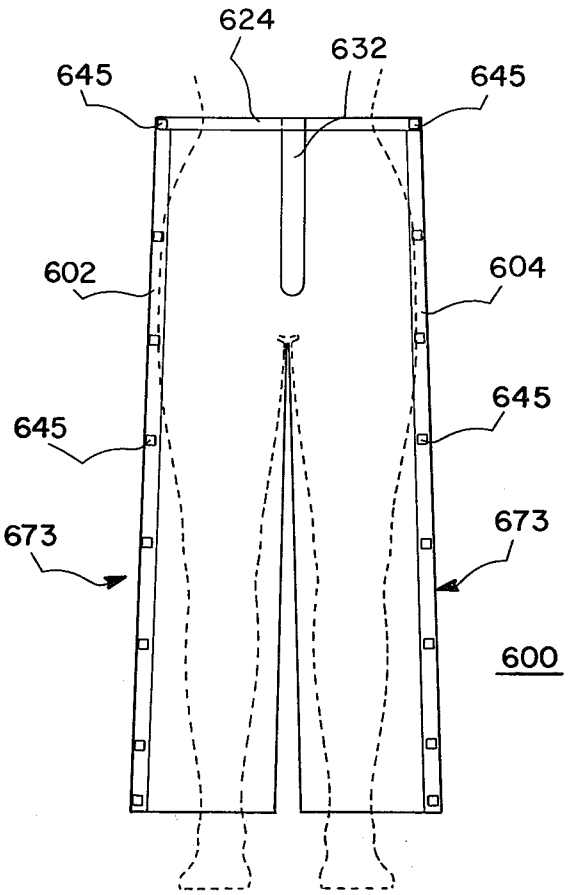
FIG. 6 is a front view of a pajama bottom in accordance with the preferred embodiment.

A pajama bottom or pants for hospital use is shown in FIG. 6. Note that the entire side of each of the pant legs comprises a finished slit 673 which is joined together by ties, fasteners, or opposing mating fabric materials. The slit may be opened for the insertion or removal of a medical appliance or simply to ease the placement (or removal) of the garment on the patient. Draw strings or light elastic banding are placed in waistband 624 to cause a comfortable yet secure fit. Fly 632 is also provided for the convenience of male patients.

Figure 7:
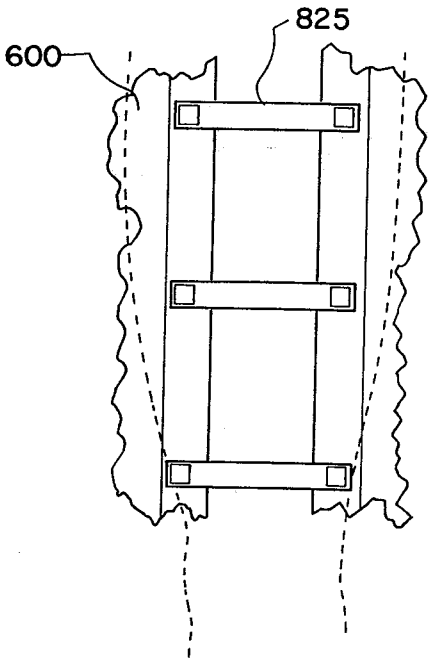
FIG. 7 is a side view of the finished slit opening of the pajama bottom of the preferred embodiment showing the extension straps in use.
Figure 8:
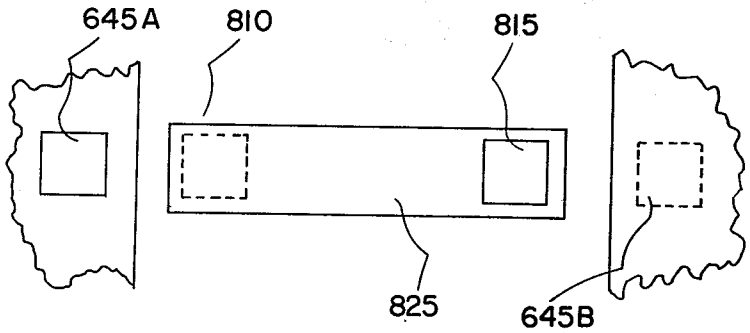
FIG. 8 is a close-up view showing the extension strap used to couple the finished edges of the slit opening.

FIGS. 7 and 8 illustrate how the preferred embodiments eliminate the practice of tearing the hospital garments when the patient is wearing a cast on the arm or leg. If ties are used they can be provided so they are long enough to tie together even when the cast is in place. If Velcro or buttons are used, then extension 825 can be used to couple the two sides of the finished slit together. FIG. 8 illustrates this operation if the pieces of opposing mating fabric material are utilized as the material for joining together the edges of the finished slits such as slits 103 and 673. The additional strap of connecting material includes pieces of mating fabric material 810 and 815 which mate with pieces 645A and 645B respectively, thus holding the two edges of the finished slit together. These extension strips are not necessary if the pant leg diameter is made large enough to accommodate the size of the cast.

I claim:

1. A hospital garment comprising:

a gown for covering at least the shoulders and the upper arms of a patient, the gown being divided to form an opening extending from the patient's neck over the shoulders and along the arms so that access may be provided to the upper body of the patient without removing the gown;

a first plurality of pieces of opposing mating fabric material affixed to the gown on opposite sides at preselected intervals along the edges of the opening for fastening together and closing the edges of the gown; and a first plurality of removable extension strips for coupling the edges of the opening of the gown in an open position, to permit the gown to be fastened when the edges of the opening cannot be brought together, each removable extension strip having a piece of opposing mating fabric material on opposite sides of each end for mating with the opposing mating fabric material affixed to the gown.

2. A hospital garment as in claim 1, further comprising:

a pants portion having a leg opening along each leg;

a second plurality of pieces of opposing mating fabric material affixed to the pants portion on opposite sides at preselected intervals along the edges of the leg portion for fastening together and closing the edges of the leg openings; and a second plurality of removable extension strips for coupling the edges of the leg opening in an open position when the edges cannot be brought together, each removable extension strip having a piece of opposing mating fabric material on the opposite sides of each end for mating with the opposing mating fabric material affixed to the pants portion.

* * * * *